US009790887B2

(12) United States Patent
Wu

(10) Patent No.: US 9,790,887 B2
(45) Date of Patent: Oct. 17, 2017

(54) PROTECTION DEVICE FOR PREVENTING AUTOMOBILE ENGINES FROM ABNORMAL STARTS AND CONTROL METHOD THEREOF

(75) Inventor: Hai Wu, Guangdong (CN)

(73) Assignee: SPACEKEY, Guangdong (CN)

( * ) Notice: Subject to any disclaimer, the term of this patent is extended or adjusted under 35 U.S.C. 154(b) by 621 days.

(21) Appl. No.: 14/124,772

(22) PCT Filed: Jun. 13, 2012

(86) PCT No.: PCT/CN2012/076851

§ 371 (c)(1),
(2), (4) Date: Dec. 9, 2013

(87) PCT Pub. No.: WO2012/174994

PCT Pub. Date: Dec. 27, 2012

(65) Prior Publication Data

US 2014/0129120 A1 May 8, 2014

(30) Foreign Application Priority Data

Jun. 20, 2011 (CN) ..... 2011 1 0165325

(51) Int. Cl.
*F02D 45/00* (2006.01)
*F02N 11/10* (2006.01)
*F02N 11/08* (2006.01)

(52) U.S. Cl.
CPC ..... *F02D 45/00* (2013.01); *F02N 11/101* (2013.01); *F02N 11/087* (2013.01)

(58) Field of Classification Search
CPC .. F02N 11/0848; F02N 11/087; F02N 11/101; F02D 45/00
See application file for complete search history.

(56) References Cited

U.S. PATENT DOCUMENTS 2,510,789 A * 6/1950 Wright ..... F02P 15/12 200/82 C
2,539,179 A * 1/1951 Bevis ..... F02N 11/0848 361/164
3,264,484 A * 8/1966 Keuchen ..... F02N 11/08 290/38 R (Continued)

*Primary Examiner* — Hieu T Vo
*Assistant Examiner* — Sherman Manley
(74) *Attorney, Agent, or Firm* — Jackson IPG PLLC; Demian K. Jackson

(57) ABSTRACT

A protection device for preventing automobile engines from abnormal starts comprises automobile batteries (10), a start motor (20) and a control circuit (30) disposed therebetween. The control circuit (30) comprises a main control unit MCU1, a start switch (31), a start relay (321) and a power supply relay (322), the coil of the start relay (321) being connected to the automobile batteries (10) through the normally closed contact of the power supply relay (322). The start relay in the present invention is connected to the batteries rather than directly but through the normally closed contact of the power supply relay. In addition to being controlled by the main control unit, the start relay is also controlled by the power supply relay, thereby providing additional insurance and more effective protection so as to avoid the damage of the start motor due to erroneous actions.

5 Claims, 3 Drawing Sheets

(56) References Cited

U.S. PATENT DOCUMENTS

| | | | | | |
|---|---|---|---|---|---|
| 3,902,074 | A * | 8/1975 | Uota | B60R 22/48 | 180/270 |
| 4,651,018 | A * | 3/1987 | Peterson, Jr. | B60K 28/00 | 180/273 |
| 4,741,306 | A * | 5/1988 | Watanabe | F01M 1/24 | 123/198 D |
| 5,180,924 | A * | 1/1993 | Rudisel | B60R 25/045 | 123/146.5 B |
| 5,345,901 | A * | 9/1994 | Siegenthaler | F02N 11/10 | 123/179.3 |
| 5,564,375 | A * | 10/1996 | Orzal | F02N 11/105 | 123/179.3 |
| 5,606,307 | A * | 2/1997 | Kuan | B60R 25/04 | 180/287 |
| 5,936,316 | A * | 8/1999 | Jurkiewicz | F02N 11/105 | 123/179.3 |
| 6,218,743 | B1 * | 4/2001 | Hayashi | F02N 11/103 | 200/61.28 |
| 6,481,404 | B1 * | 11/2002 | Perry | F02D 41/3082 | 123/179.3 |
| 6,681,736 | B2 * | 1/2004 | Sumimoto | F02N 11/0848 | 123/179.12 |
| 2002/0112689 | A1 * | 8/2002 | Nagae | F02N 11/0803 | 123/179.3 |
| 2004/0104579 | A1 * | 6/2004 | Kitagawa | F02N 11/10 | 290/36 R |
| 2006/0131958 | A1 * | 6/2006 | Brooks | B60R 25/045 | 307/10.3 |
| 2010/0134934 | A1 * | 6/2010 | Matsubara | F02N 11/101 | 361/49 |

* cited by examiner

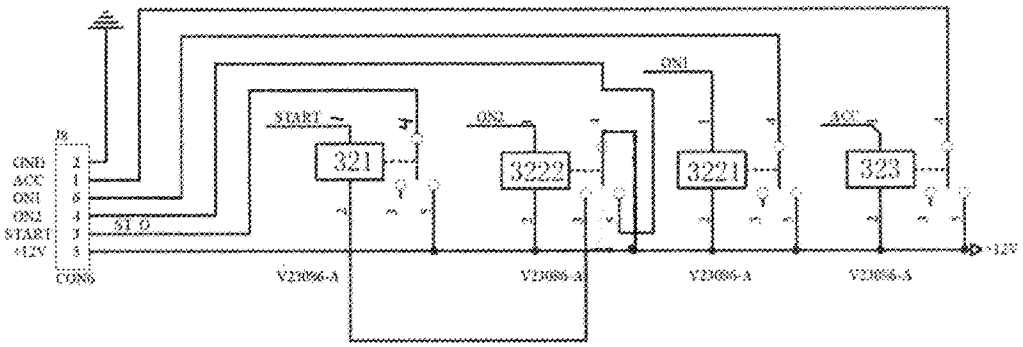
321
322
322'
322'
323
V2806-1
V2806-2
V2806-3
V2806-4
V2806-5
V2806-6
V2806-7
V2806-8
V2806-9
V2806-10
V2806-11
V2806-12
V2806-13
V2806-14
V2806-15
V2806-16
V2806-17
V2806-18
V2806-19
V2806-20
V2806-21
V2806-22
V2806-23
V2806-24
V2806-25
V2806-26
V2806-27
V2806-28
V2806-29
V2806-30
V2806-31
V2806-32
V2806-33
V2806-34
V2806-35
V2806-36
V2806-37
V2806-38
V2806-39
V2806-40

PROTECTION DEVICE FOR PREVENTING AUTOMOBILE ENGINES FROM ABNORMAL STARTS AND CONTROL METHOD THEREOF

FIELD OF THE INVENTION

The present invention relates to automobile control technology, in particular to control technology for automobile start circuits.

BACKGROUND OF THE INVENTION

In the prior art, an automobile start circuit is such designed that the coil of a start relay is directly connected to automobile batteries, thus, the automobile starts when an ignition switch is turned to the ignition gear. However, the coil of the start relay is still connected to the automobile batteries at that time; in this case, if the main control chip goes wrong and gives a restart signal, the start relay will be closed again to cause the start motor to restart. As a result, the start motor may be easily damaged.

SUMMARY OF THE INVENTION

The present invention provides a protection device for preventing automobile engines from abnormal starts and a control method thereof. The present invention intends to solve the technical problem in the prior art that the start motor may be easily damaged due to malfunction, by connecting the coil of the start relay to the batteries through the normally closed contact of the power supply relay such that the start relay is unable to be connected to the batteries directly.

The protection device provided by the present invention for solving the technical problem described above comprises automobile batteries, a start motor and a control circuit disposed therebeween, the control circuit comprising a main control unit MCU, a start switch connected to the main control unit MCU and a control relay group, the start switch at least comprising an ignition gear and a power supply gear, the control relay group comprising at least a start relay and a power supply relay, the coil of the start relay being connected to the automobile batteries through the normally closed contact of the power supply relay. The control circuit further comprises a monitoring unit MCU connected to the main control unit MCU. First, when an ignition switch is turned to the ignition gear, the start relay acts and the automobile starts; then, after the automobile starts, the ignition switch returns to the power supply gear automatically and the normally closed contact of the power supply relay is shut off, as a result, the coil of the start relay is powered off so that the start motor is unable to restart.

The start switch comprises the following four gears: an ACC power supply gear, a first power supply gear, a second power supply gear and the ignition gear; the power supply relay includes a first power supply relay and a second power supply relay, the first power supply relay and the second power supply relay being corresponding to the first power supply gear and the second power supply gear of the start switch, respectively; and the coil of the start relay is connected to the automobile batteries through the normally closed contact of the second power supply relay. After the automobile starts, the ignition switch returns to the second power supply gear automatically and the normally closed contact of the second power supply relay is shut off, as a result, the coil of the start relay is powered off so that the start motor is unable to restart.

The start relay in the present invention is connected to the batteries rather than directly but through the normally closed contact of the power supply relay. In addition to being controlled by the main control unit, the start relay is also controlled by the power supply relay, thereby providing additional insurance and more effective protection so as to avoid the damage of the start motor due to erroneous actions.

BRIEF DESCRIPTION OF THE DRAWINGS

FIG. 3 is a circuit wiring diagram according to the present invention.

DETAILED DESCRIPTION OF THE PREFERRED EMBODIMENTS

Specific embodiments of the present invention will be described with reference to the accompanying drawings. As used herein, the term "gear" means a switch position or the open/closed position of a switch, not a set of toothed wheels that work together to alter the relation between the speed of a driving mechanism.

Figure 1:
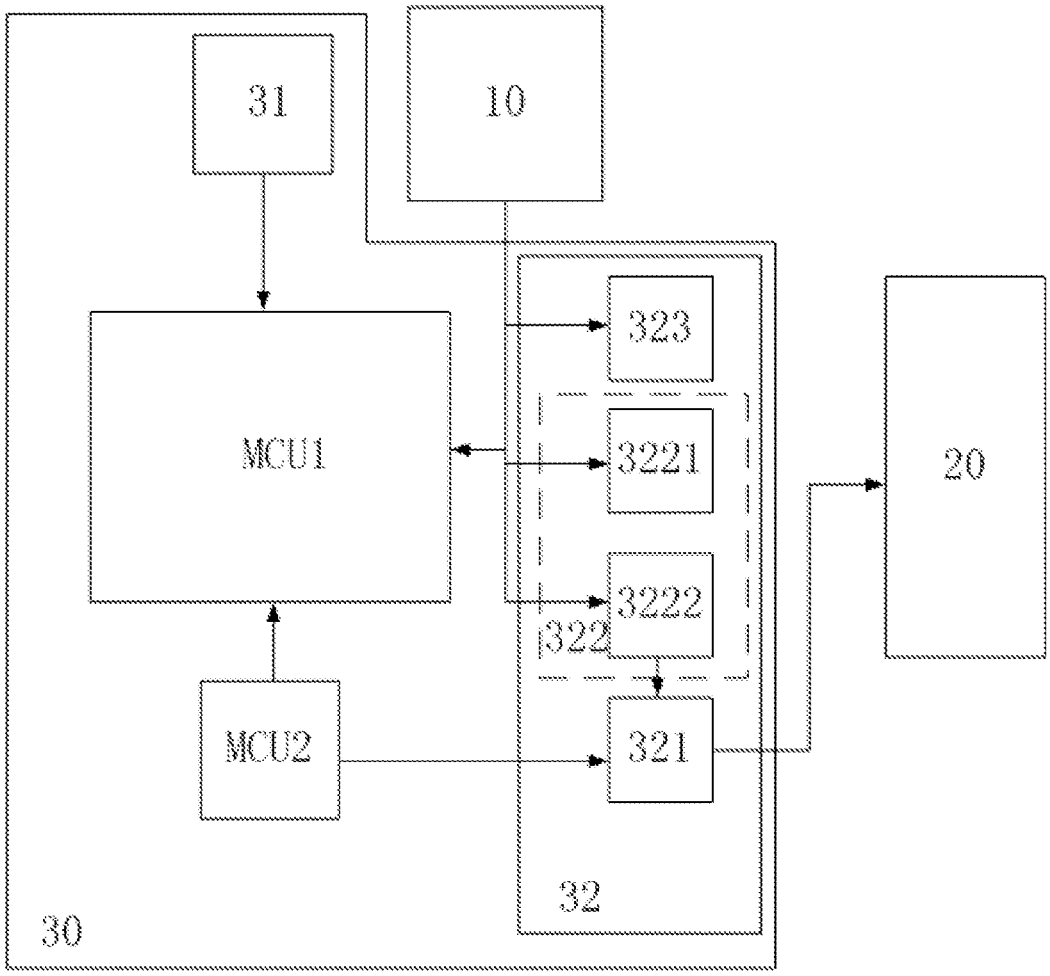
FIG. 1 is a functional block diagram of a protection device according to the present invention.
Figure 2:
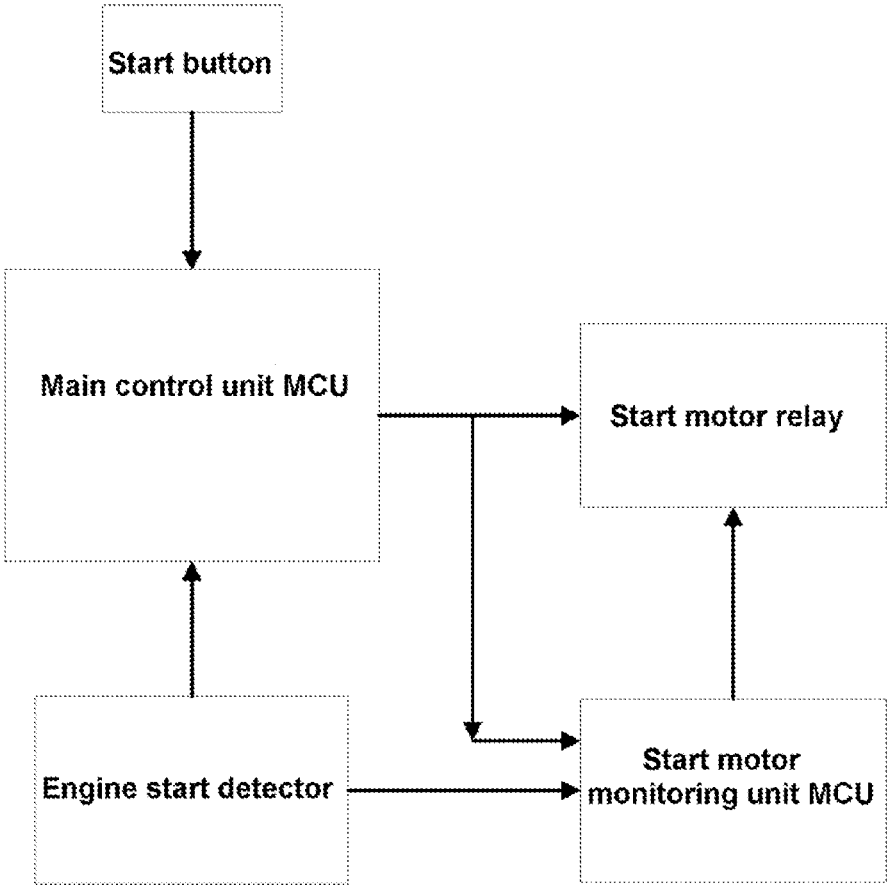
FIG. 2 is a functional block diagram of control according to the present invention.

Referring to FIG. 1 to FIG. 3, a protection device for preventing automobile engines from abnormal starts comprises automobile batteries 10, a start motor 20 and a control circuit 30 disposed therebetween, the control circuit 30 comprising a main control unit MCU1, a start switch 31 connected to the main control unit MCU1 and a control relay group 32, the start switch 31 at least comprising an ignition gear and a power supply gear, the control relay group 32 comprising at least a start relay 321 and a power supply relay 322, the coil of the start relay 321 being connected to the automobile batteries 10 through the normally closed contact of the power supply relay 322. In addition to being controlled by the main control unit MCU1, the start relay of the present invention is also controlled by the power supply relay. When not started, the automobile batteries may supply power to the coil of the start relay though the normally closed contact of the power supply relay; and when the ignition switch is turned to the ignition gear, if detecting a user pressing down the start switch module and determining this is a legal start by comparison, the main control unit MCU1 starts to drive the start motor relay, as a result, the start relay acts and the automobile starts. After the automobile starts, the ignition switch returns to the power supply gear automatically and the normally closed contact of the power supply relay is shut off after the power supply relay is powered on, as a result, the coil of the start relay is powered off and the start motor is unable to restart. At this time, even though the main control unit MCU1 gives a start signal, the start motor is unable to restart as the start relay is unable to act. Only when the ignition switch is manually turned to the ignition gear again, the start motor is able to act again. In this way, the start motor is effectively protected.

Referring to FIG. 2, the control circuit 30 further comprises a monitoring unit MCU2 connected to the main control unit MCU1. During the start of the engine, the start motor monitoring unit MCU2 starts timing to the output control time of the main control unit MCU1. When it is detected that the main control unit MCU1 outputs an output control time exceeding a predetermined output control time (usually, 4 s), the monitoring unit MCU2 will cut off the control of the start relay to power the start motor off so as to protect the motor from being burnt.

Referring to FIG. 1, the start switch 31 comprises the following four gears: an ACC power supply gear, a first power supply gear, a second power supply gear and the ignition gear. The power supply relay 322 includes a first power supply relay 3221 and a second power supply relay 3222, the first power supply relay 3221 and the second power supply relay 3222 being corresponding to the first power supply gear and the second power supply gear of the start switch 31, respectively, the ACC power supply relay 323 being corresponding to the ACC power supply gear. The coil of the start relay 321 is connected to the automobile batteries 10 through the normally closed contact of the second power supply relay 3222. After the automobile starts, the ignition switch returns to the second power supply gear automatically and the normally closed contact of the second power supply relay is shut off, as a result, the coil of the start relay is powered off so that the start motor is unable to restart.

The present invention has been further described above in details in combination with preferred specific embodiments, but it should not be considered that the present invention is limited to those descriptions. For those skilled in the art, various simple derivations and alternations may be also possible without departing from the conception of the present invention, and these derivations and alternations shall fall into the protection scope of the present invention.

What is claimed is:

1. A protection device for preventing automobile engines from abnormal starts, comprising
- automobile batteries (10),
- a start motor (20) and
- a control circuit (30) disposed therebetween, the control circuit (30) comprising
  - a main control unit MCU1,
  - a start switch (31) connected to the main control unit MCU1 and at least comprising an ignition gear and a power supply gear,
  - a control relay group comprising:
    - at least a start relay (321) wherein the start relay acts when an ignition switch is turned to the ignition gear, and the automobile starts and
    - a power supply relay (322),
  - wherein the coil of the start relay (321) is connected to the automobile batteries (10) through the normally closed contact of the power supply relay (322) and wherein after the automobile starts, the ignition switch returns to the power supply gear automatically and the normally closed contact of the power supply relay is shut off, as a result, the coil of the start relay is powered off so that the start motor is unable to restart,
- wherein the start switch (31) comprises the following four gears:
  - an ACC power supply gear,
  - a first power supply gear,
  - a second power supply gear and
  - the ignition gear;
- the power supply relay (322) includes
  - a first power supply relay (3221) and
  - a second power supply relay (3222),
    - the first power supply relay (3221) and the second power supply relay (3222) being corresponding to the first power supply gear and the second power supply gear of the start switch (31), respectively; and
  - the coil of the start relay (321) is connected to the automobile batteries (10) through the normally closed contact of the second power supply relay (3222).

2. The protection device for preventing automobile engines from abnormal starts according to claim 1, wherein the control circuit (30) further comprises a monitoring unit MCU2 being connected to the main control unit MCU1.

3. A method for controlling the protection device for preventing automobile engines from abnormal starts as of claim 1, comprising the following steps:
- a) the start relay acts when an ignition is turned to the ignition gear, and the automobile starts; and
- b) after the automobile starts, the ignition switch returns to the second power supply gear automatically and the normally closed contact of the second power supply relay is shut off, as a result, the coil of the start relay is powered off so that the start motor is unable to restart.

4. A protection device for preventing automobile engines from abnormal starts, comprising
- automobile batteries,
- a start motor and
- a control circuit connected between the batteries and the start motor and comprising
  - a main control unit MCU1,
  - a start switch connected to the main control unit MCU1 and comprising the following four gears:
    - an ACC power supply gear,
    - a first power supply gear,
    - a second power supply gear and
    - an ignition gear;
  - a control relay group comprising at least a start relay that acts when an ignition is turned to the ignition gear and the automobile starts and a power supply relay comprising:
    - a first power supply relay and
    - a second power supply relay wherein the first power supply relay and the second power supply relay correspond to the first power supply gear and the second power supply gear of the start switch respectively and wherein the coil of the start relay is connected to the automobile batteries through the normally closed contact of the power supply relay and wherein, after the automobile starts, the ignition switch returns to the second power supply gear automatically and the normally closed contact of the second power supply relay is shut off and, as a result, the coil of the start relay is powered off so that the start motor is unable to restart.

5. A protection device for preventing automobile engines from abnormal starts, comprising:
- automobile batteries;
- a start motor; and
- a control circuit connected between the batteries and the start motor and comprising:
  - a main control unit MCU1,
  - a monitoring unit MCU2 connected to the main control unit MCU1,
  - a start switch connected to the main control unit MCU1 and comprising the following four gears:
    - an ACC power supply gear,
    - a first power supply gear,
    - a second power supply gear and an ignition gear; and a control relay group comprising at least a start relay, and a power supply relay comprising a first power supply relay and a second power supply relay corresponding to the first power supply gear and the second power supply gear of the start switch respectively and wherein the coil of the start relay is connected to the automobile batteries through the normally closed contact of the power supply relay.

* * * * *